US005347969A

United States Patent [19]

Gmelin et al.

[11] Patent Number: 5,347,969

[45] Date of Patent: Sep. 20, 1994

[54] CONTACT STRIP FOR PROVIDING COMMON ELECTRICAL CONNECTION OF SEVERAL ELECTRICALLY OPERATED FUEL INJECTION VALVES

[75] Inventors: Karl Gmelin, Flein; Thomas Gregorius, Gerlingen, both of Fed. Rep. of Germany

[73] Assignee: Robert Bosch GmbH, Stuttgart, Fed. Rep. of Germany

[21] Appl. No.: 952,727

[22] PCT Filed: Feb. 20, 1992

[86] PCT No.: PCT/DE92/00120

§ 371 Date: Nov. 23, 1992

§ 102(e) Date: Nov. 23, 1992

[87] PCT Pub. No.: WO92/16736

PCT Pub. Date: Oct. 1, 1992

[30] Foreign Application Priority Data

Mar. 23, 1991 [DE] Fed. Rep. of Germany ..... 4109653

[51] Int. Cl.[5] ..... F02M 55/02; H01R 23/02

[52] U.S. Cl. ..... 123/456; 123/470; 439/130

[58] Field of Search ..... 123/472, 456, 469, 470, 123/468; 439/130, 652, 76, 79, 80

[56] References Cited

U.S. PATENT DOCUMENTS

| | | | |
|---|---|---|---|
| 4,570,601 | 2/1986 | Ito . | |
| 4,857,003 | 8/1989 | Hafner | 123/456 |
| 4,950,171 | 8/1990 | Muzslay | 123/456 |
| 5,030,116 | 7/1991 | Sakai | 123/456 |
| 5,127,382 | 7/1992 | Imoehl | 123/456 |
| 5,131,857 | 7/1992 | Gmelin | 123/456 |
| 5,178,114 | 1/1993 | McArthur | 123/456 |
| 5,178,115 | 1/1993 | Daly | 123/456 |
| 5,189,782 | 3/1993 | Hickey | 123/456 |
| 5,203,304 | 4/1993 | Hafner | 123/456 |
| 5,211,149 | 5/1993 | DeGrace | 123/456 |
| 5,226,391 | 7/1993 | Gras | 123/456 |

FOREIGN PATENT DOCUMENTS

| | | |
|---|---|---|
| 0302608 | 2/1989 | European Pat. Off. . |
| 0306739 | 3/1989 | European Pat. Off. . |
| 0374422 | 6/1990 | European Pat. Off. . |
| 0416834 | 3/1991 | European Pat. Off. . |
| 3725980 | 8/1988 | Fed. Rep. of Germany . |
| 8903551 | 7/1990 | Fed. Rep. of Germany . |
| 2073316 | 10/1981 | United Kingdom . |
| 9013740 | 11/1990 | World Int. Prop. O. . |

*Primary Examiner*—Carl S. Miller

*Attorney, Agent, or Firm*—Edwin E. Greigg; Ronald E. Greigg

[57] ABSTRACT

A contact strip which includes a contact strip housing and a support part, which has conductor channels with connection leads extending within the conductor channels. Projecting from the contact strip are electrical connection leads in a lead line which serve to contact the fuel injection valves and which are fitted with plug elements, which contact electrical conductors of the fuel injection valves. The contact strip has an advantage of providing a contact to several fuel injection valves, which may be of any kind of construction, in a simple and reliable manner. The contact strip is particularly suitable for making common electrical contact to electrically operated fuel injection valves of internal combustion engines.

16 Claims, 5 Drawing Sheets

Figure 1:
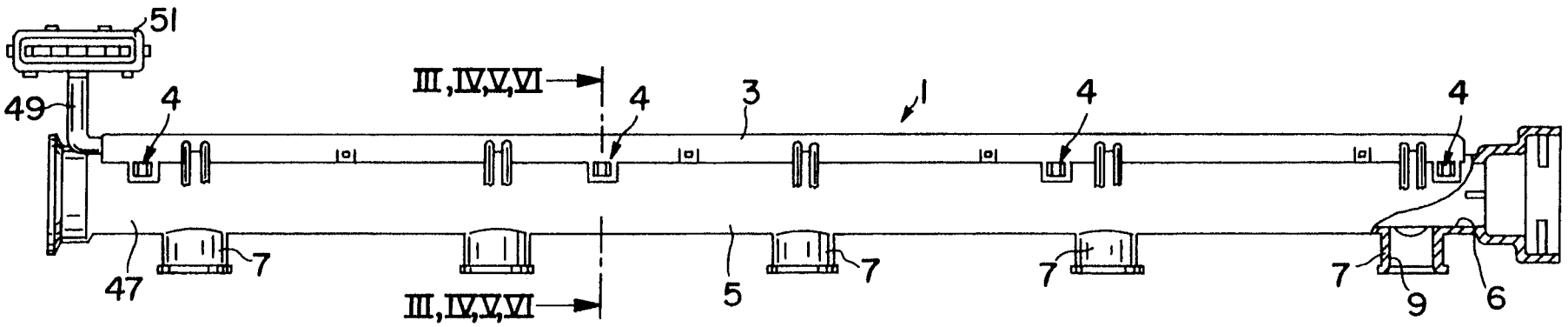

CONTACT STRIP FOR PROVIDING COMMON ELECTRICAL CONNECTION OF SEVERAL ELECTRICALLY OPERATED FUEL INJECTION VALVES

The invention is based on a contact strip of the type set forth hereinafter. From the DE 37 25 980 Al, a contact strip for the common electrical connection of several electrically operated fuel injection valves is known, which has a contact strip housing with conductor channels, in which the electrically operated fuel injection valves are arranged. The contact strip housing has a number of fuel injection valves corresponding to the number of plugs; these plugs partly surround the fuel injection valves in the direction of the longitudinal axis of the valve, on their ends which face away from the injection ends and which carry the connection plugs, electrically contact the connecting plugs. This contact strip is suitable only for side feed and bottom feed fuel injection valves, i.e. fuel injection valves which have the fuel fed to their circumference, and the electrical connection of which is made at the end which faces away from the injection end.

When during operation of the internal combustion engine, the fuel injection valves are caused to vibrate, then relative movements will occur between the contact strip which is rigidly mounted on a suction pipe of the internal combustion engine, for example, and the fuel injection valves, which can lead to high wear on the contact elements of the contact strip plugs and the connecting plugs of the fuel injection valves.

ADVANTAGES OF THE INVENTION

In contrast, the contact strip in accordance with the invention has an advantage that it ensures a simple and secure contact being made to several electrically operated fuel injection valves, which may be of any type of construction. The support part which is connected to the contact strip housing and which has at least one conductor channel, can be made very simply and inexpensively and permits a very compact design of the contact strip of this invention.

The electrical connection leads projecting from the contact strip can be provided with different electrical plug elements, so that the contact strip can be used for contacting various types of fuel injection valves.

Separate connection of the individual fuel injection valves enables free movement of the fuel injection valves to compensate for tolerances during assembly and temperature related expansions during operation of the internal combustion engine. Moreover, there is hardly any relative movement between the fuel injection valve and the electrical plug element concerned, in spite of vibratory stress during operation of the internal combustion engine.

The contact strip of the invention permits an assembly and service-friendly overall system, consisting, for example, of the contact strip and a fuel distributor. An individual fuel injection valve can be checked without problem. Attachment of the fuel distributor to a suction pipe of the internal combustion engine, for example, is independent of the fixing of the contact strip, so that the contact strip can be dismantled individually.

The contact strip itself can be manufactured in a simple and inexpensive manner.

The measures listed in the subordinate claims permit advantageous developments and improvements of the contact strip specified in the main claim.

It is of particular advantage if the side faces of at least one grooved conductor channel of the support part are formed by two adjacent lands, which are arranged on the support part, so that the grooved conductor channels can be produced with particular ease.

For a simple and reliable connection of the support part and contact strip housing, it is of advantage if the support part is connected to the contact strip housing by a snap-on connection.

For the same reason, it is further of advantage if the contact strip housing is formed by at least a partial plastic moulding encapsulation of the support part.

It is of advantage if the support part is a component part of the contact strip housing. A contact strip thus shaped can be made easily and economically.

To ensure a secure and reliable retention of the electrical connecting leads in the conductor channel, it is of advantage, if at least one electrical connecting lead is retained in the conductor channel of the support part by a thermal deformation of the plastic support part.

It is of advantage, if the contact strip can be connected to a fuel distributor in a simple manner by means of a snap-on connection.

For a simple electrical connection of the contact strip, it is of advantage, if an electrical connection plug is injection moulded onto the contact strip housing to provide the electrical connection of the contact strip.

DRAWING

Embodiment examples of the invention are shown simplified in the drawing and are more closely described in the description which follows.

Figure 2:
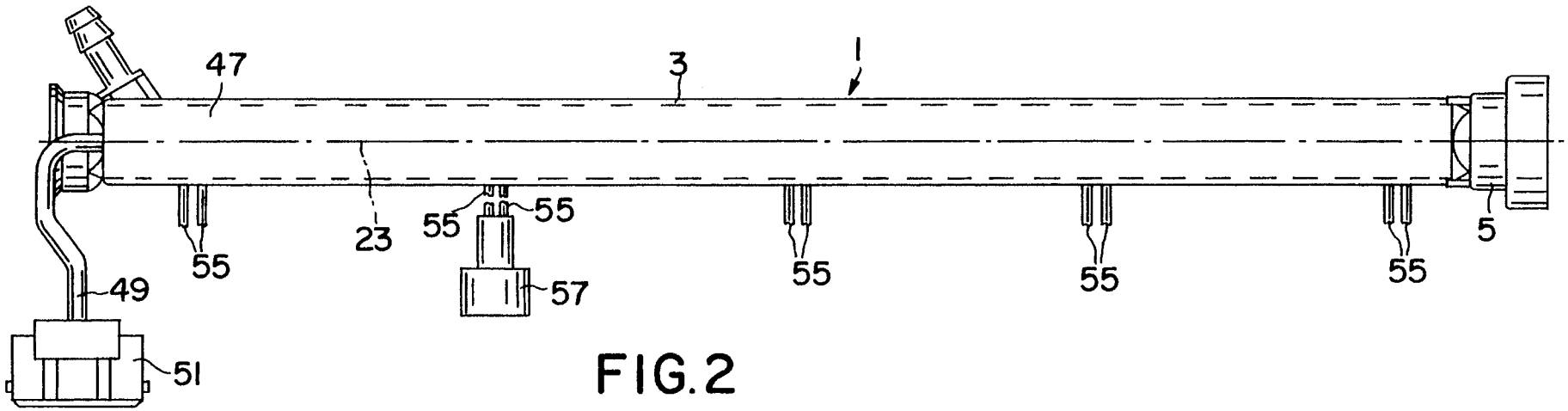
Figure 3:
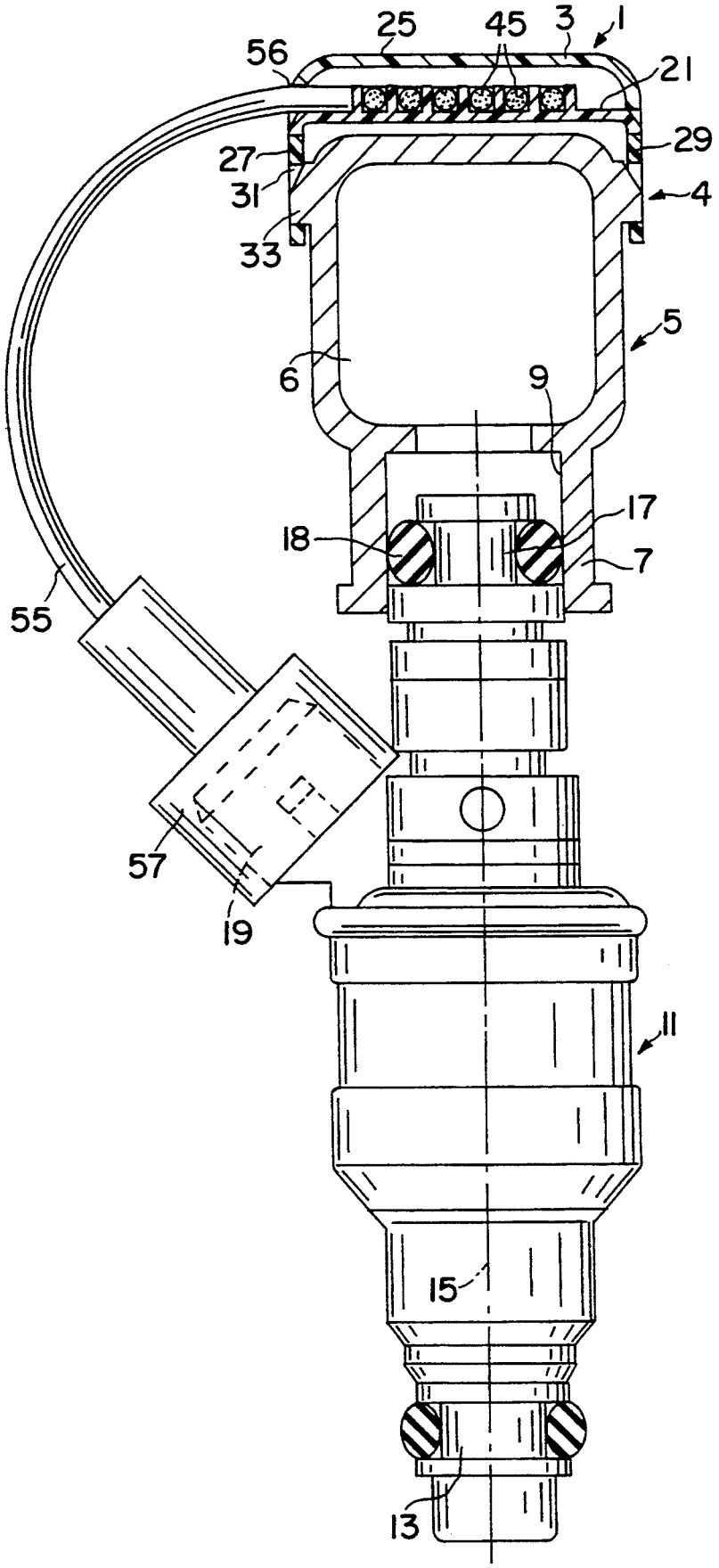
Figure 4:
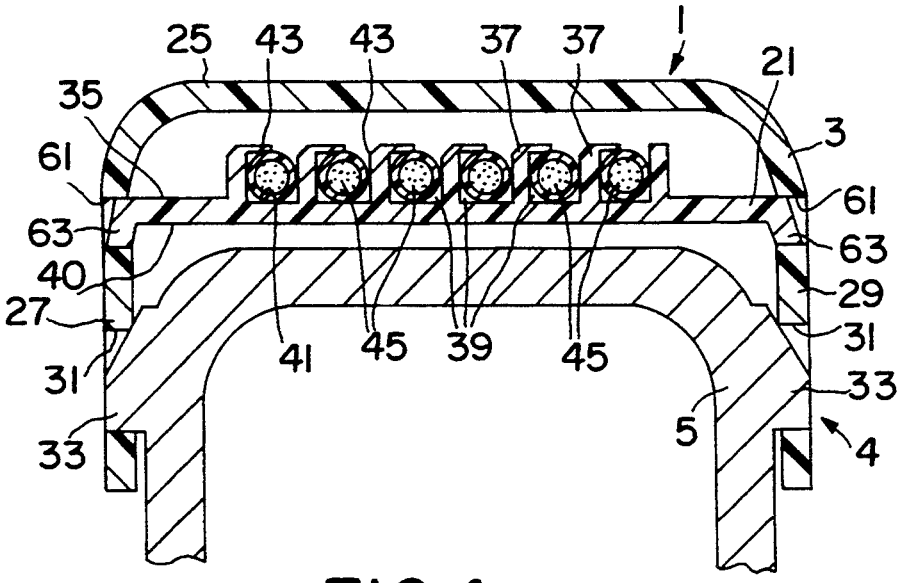
Figure 5:
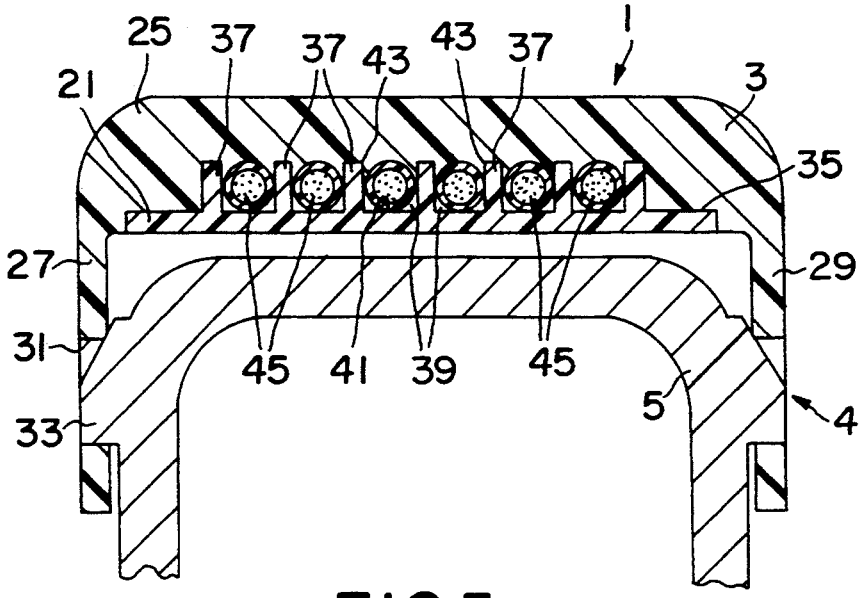
Figure 6:
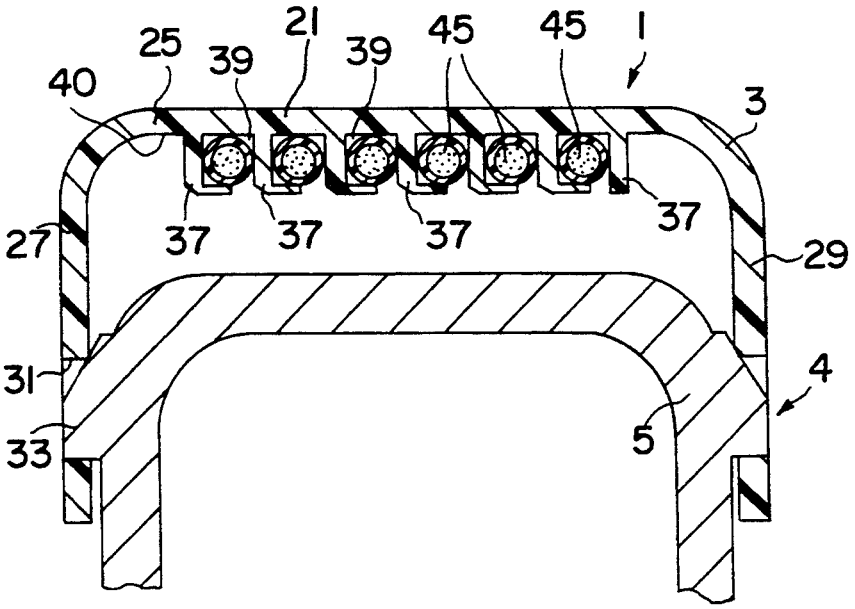
Figure 7:
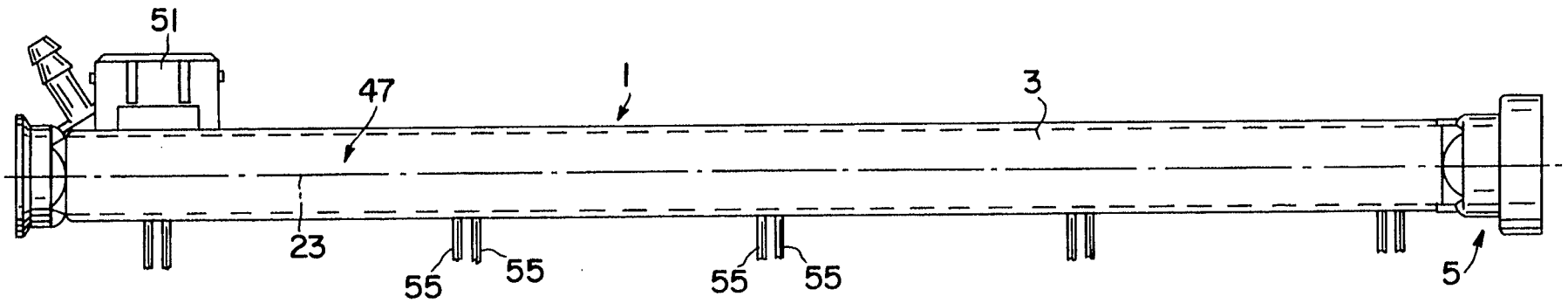

FIGS. 1 and 2 show a contact strip as a first, a second, or a third embodiment example constructed in accordance with the invention, FIG. 3 shows a section along the line III—III in FIG. 1 in accordance with the first embodiment example with a fuel injection valve, FIG. 4 shows a partially section along the line IV—IV in FIG. 1 in accordance with the first embodiment example, FIG. 5 shows a partial section along the line V—V in FIG. 1 in accordance with the second embodiment example, FIG. 6 shows a partial section along the line VI—VI in FIG. 1 in accordance with the third embodiment example, FIG. 7 shows a contact strip in accordance with the fourth embodiment example of the invention.

DDESCRIPTION OF THE EMBODIMENT EXAMPLE

The contact strip shown as an example in the drawing in FIGS. 1, 2, and 7, to provide a common electrical connection of several electrically operated fuel injection valves for fuel injection units, for example, of a mixture compressing spark ignited internal combustion engine, is designated 1. The contact strip 1 has a contact strip housing 3 and is connected to a fuel distributor 5, for example, using a snap-on connection 4. The fuel distributor 5 is used for the supply of fuel to the injection valves and has, for example, a central inflow cross-section 6 and a number of connection pieces 7 which correspond to the number of cylinders, in the engine and which are in connection with the central inflow cross-section 6. The connection pieces 7 each have a longitudinal aperture 9, which is used to accommodate an inflow end 17 of a fuel injection valve 11 of the top feed design, for example, as shown in FIG. 3. At one of its ends, the fuel injection valve 11 has a discharge end 13, and on its end facing away from the discharge end 13, it has the inflow end 17 which extends concentrically with a valve longitudinal axis 15. The fuel injection valves 11 are arranged with their inflow ends 17 in the longitudinal apertures 9 of the connection pieces 7 of the fuel distributor 5 such that the longitudinal apertures 9 tightly and closely surround the inflow ends 17 of the fuel injection valves 11 using a sealing ring 18 as an intermediate spacer. On their circumference, the fuel injection valves 11 have connection plugs 19 which are inclined relative to the particular valve longitudinal axis 15 towards the discharge end 13 and which are used to provide the electrical connection of the particular fuel injection valve 11.

The contact strip 1 consists of the contact strip housing 3, which has an approximately 'U' shaped cross-section, for example, and a plate-like support part 21 formed of a plastic material, and extends in the direction of a longitudinal axis 23. The contact strip housing 3 has a central cover part 25 which extends in the direction of the longitudinal axis 23. The cover part 25 connects at its side with a first leg 27 and a second leg 29 which are at right angles in relation to the cover part 25 and parallel to each other and extend like the cover part 25 in the direction of the longitudinal axis 23 of the contact strip 1. The plate-like support part 21 is arranged in the contact strip housing 3 such that it is partially surrounded by the contact strip housing 3 and extends between the legs 27, 29 and parallel to the cover part 25.

Alternatively, the support part 21 may have a square, circular, or oval cross-section rather than a plate-like cross-section.

Facing away from the cover part 25, the legs 27, 29 of the contact strip housing 3 have a plurality of first housing breakthroughs 31, into which project, when assembled, detents 33 which are constructed on the circumference of the fuel distributor 5 and thus form the snap-on connection 4 between the contact strip 1 and the fuel distributor 5. Alternatively, it is possible for recesses to be designed on the circumference of the fuel distributor 5 and for detents 33 to be arranged on the legs 27, 29 of the contact strip housing 3 so that the recesses and the detents 33 form the snap-on connection 4. It is further possible that the contact strip 1 and the fuel distributor 5 can be connected to each other by means of a screwed connection, a glued connection, a stapled or some other connection.

The plate-like support part 21 has, for example, at least two lands 37 on its upper front face 35 which faces away from the fuel distributor 5 and faces towards the cover part 25 of the contact strip housing 3, it has seven such lands 37 in the shown embodiment examples. The lands 37 extend parallel to the longitudinal axis 23 of the contact strip 1. Grooved conductor channels 39 are provided between any two adjacent lands 37. The grooved conductor channels 39 have a floor 41, which is formed by the top front face 35 of the support part 21, and side faces 43, which are formed by the two adjacent lands 37. The grooved conductor channels 39 are open towards the cover part 25 of the contact strip housing 3. Alternatively, it is possible to form lands 37 at a lower front face 40 of the support part 21, facing away from the cover part 25 of the contact strip housing 3, between which there are grooved conductor channels 39.

In the six grooved conductor channels 39, there is at least one electrical connection lead 45 provided, in the shown embodiment examples it is just one. To prevent the electrical connection leads 45 from slipping out of the grooved conductor channels 39 of the support part 21, the electrical connection leads 45 can be retained in the grooved conductor channels 39, as in the first embodiment example, by a deformation of the lands 37 of the support part 21 which is made of a plastic material. A thermal deformation can be achieved, for example, by caulking the material of the lands 37 of the support part 21 towards each other by means of ultrasonic welding.

The connection leads 45 which are arranged in conductor channels 39 can be provided with a plastic insulation, such as shown in the embodiment examples. A plastic insulation can be dispensed with, if the support part 21 with its lands 37 is constructed—as in the embodiment examples—from an electrically insulating plastic material.

The connection leads 45 project with one of their ends from an end 47 of the contact strip 1 in the form of an electrical connection cable 49 (FIG. 1) and are electrically connected to a connection plug 51. Electrical control signals for the electrically operated fuel injection valves can be input via the connection plug 51, from an electronic control unit of a known design, which is not shown.

Alternatively, it is possible, as shown by the fourth embodiment example presented in FIG. 7, to mould the electrical connection plug 51, which serves to provide the electrical connection of the contact strip 1, directly onto the contact strip housing 3 of the contact strip 1 in the region of the end 47 of the contact strip 1.

The electrical connection leads 45 extend in the conductor channels 39 of the support part 21 and branch within the contact strip 1 into electric connection leads 55 (FIG. 3), which serve to provide direct electrical connection of the individual electrically operated fuel injection valves 11 and which project from apertures 56 out of the contact strip housing 3. The branching points where the electrical connection leads 45 branch into electric connection leads 55, are electrically insulated in a manner not shown, by encapsulation, gluing, or sealing by means of an elastomer.

The connection leads 55, of which there are at least two, project with their one end in each case from the contact strip 1. In the embodiment examples presented, two contact leads are provided for each fuel injection valve 11, the two contact leads project from the contact strip 1 in the region of the particular connection piece 7 of the fuel distributor 5 and are contained in one leadline 55. The two connection leads in lead line 55 which serve to provide the electrical connection with a fuel injection valve 11 are electrically connected to an electric plug element 57, as shown in FIG. 3.

These plug elements 57 themselves can be connected to the connection plugs 19 of the fuel injection valves 11, so that the electrically operated fuel injection valves can be connected in this way, simply and reliably.

The use of different plug elements 57 facilitates connection to various fuel injection valves 11, so that the contact strip 1 can be variously applied.

In the first embodiment example in accordance with the invention, which is presented in FIGS. 3 and 4, the support part 21 and the contact strip housing 3 are connected to each other by means of a snap-on connection. For this purpose, the contact strip housing 3 has at its legs 27, 29 between the first housing breakthroughs 31 and the cover part 25, second housing breakthroughs 61. The support part 21 has at its sides which face the legs 27, 29 several detents 63 extending parallel to the longitudinal axis 23, which project into the housing breakthroughs 61 of the legs 27, 29 of the contact strip housing 1, thereby forming a firm and reliable snap-on connection between the support part 21 and the contact strip housing 3. It is possible to provide recesses on the legs 27, 29 instead of the second housing breakthroughs 61 of the legs 27, 29, in which recesses the detents 63 will engage. Alternatively, the support part 21 may have longitudinal shoulders or grooves formed on it, which interact with the legs 27, 29 of the contact strip housing 3.

Alternatively, it is possible that the contact strip housing 3 is constructed as in the second embodiment example shown in FIG. 5 by at least partial plastic encapsulation of the support part 21. For this purpose, the support part 21 with the connection leads 45 is surrounded in the region of its upper front face 35 by the plastic injection moulding which forms the contact strip housing 3 together with the legs 27, 29. In this way, the contact strip 1 in accordance with this invention can be manufactured particularly simply and economically. Moreover, a particularly secure and reliable retention of the connection leads 45 in the grooved conductor channels 39 of the support part 21 is ensured.

FIG. 6 shows a third embodiment example of a contact strip 1 in accordance with the invention, in which a separate support part, as in the previous embodiment examples, is absent. Instead, lands 37 are formed on the lower front face 40 of the cover part 25 of the contact strip housing 3 which faces the fuel distributor 5, between the legs 27, 29, these lands extend parallel to the longitudinal axis 23 of the contact strip 1 and, together with the cover part 25, take over the function of the previous support part 21. Grooved conductor channels 39 are constructed between each two adjacent lands 37, and these are open in the direction of the fuel distributor 5. In each of the conductor channels 39, an electrical connection lead 45 is arranged which is retained in the grooved conductor channels 39 by a thermal deformation of the lands 37 of the contact strip housing 3 which is made of a plastic material. The previous separate support part 21 is thus integrated in the contact strip housing 3 which has an approximately 'U' shaped cross-section. In this embodiment example, the connection leads 55 with the plug elements 57 correspond to the previously described embodiment examples. Such a contact strip 1 can be manufactured particularly simply and economically.

The contact strip 1 of the invention makes it possible for several electrically operated fuel injection valves, which may be of any type, to be connected simply and reliably. The contact strip 1 can be manufactured in a simple and economic manner.

We claim:

1. A contact strip that provides a common electrical connection to several electromagnetically operated fuel injection valves, which comprises a contact strip housing and at least two electrical connection leads which are arranged in at least one conductor channel, the contact strip (1) has at least one support part (21) which has at least one conductor channel (39), said at least one support part (21) and said contact strip housing are separate individual parts and said at least one support part (21) is connected to the contact strip housing (3), and at least two electrical connection leads in a lead line (55) project from the contact strip (1) and which serve to provide a connection to the electrically operated fuel injection valves (11).

2. A contact strip in accordance with claim 1, which includes at least one conductor channel (39), in which the support part (21) has side faces (43), which are formed by two adjacent lands (37) constructed on the support part (21).

3. A contact strip in accordance with claim 1, in which the support part (21), is arranged in the contact strip housing (3) and connected to the contact strip housing by means of a snap-on connection (4).

4. A contact strip in accordance with claim 2, in which the support part (21), is arranged in the contact strip housing (3) and connected to the contact strip housing by means of a snap-on connection (4).

5. A contact strip in accordance with claim 1, in which the contact strip housing (3) is formed by at least partial plastic encapsulation of the support part (21).

6. A contact strip in accordance with claim 2, in which the contact strip housing (3) is formed by at least partial plastic encapsulation of the support part (21).

7. A contact strip in accordance with claim 1, in which the support part (21) is made of a plastic material.

8. A contact strip in accordance with claim 2, in which the support part (21) is made of a plastic material.

9. A contact strip in accordance with claim 3, in which the support part (21) is made of a plastic material.

10. A contact strip in accordance with claim 5, in which the support part (21) is made of a plastic material.

11. A contact strip in accordance with claim 11, in which the support part (21) is made of a plastic material.

12. A contact strip in accordance with claim 2, which includes at least one electrical connection lead (45) said at least one electrical lead is retained in the particular conductor channel (39) of the support part (21) by a deformation of the support part (21) .

13. A contact strip in accordance with claim 1, in which the contact strip (1) is connected to the fuel distributor (5) by means of a snap-on connection.

14. A contact strip in accordance with claim 1, in which the contact strip housing (3) has an electrical connection plug (51) injection moulded onto said contact strip housing to provide electrical connection of the contact strip (1).

15. A contact strip in accordance with claim 1, in which at least two electrical connection leads (45) project from the contact strip (1) and are connected to an electrical connection plug (51) which serve to provide the electrical connection of the contact strip (1).

16. A contact strip that provides a common electrical connection to several electromagnetically operated fuel injection valves, which comprises a contact strip housing and at least two electrical connection leads which are arranged in at least one conductor channel, the contact strip (1) has at least one support part (21) which has one conductor channel (39) in which the at least one support part (21) has side faces (43) which are formed by two adjacent lands (37) constructed on the at least one support part (21), and said at least one support part (21) is a component part of the contact strip housing (3), and at least two electrical connection leads in a lead line (55) project from the contact strip (1) and which serve to provide a connection to the electrically operated fuel injection valves (11).

* * * * *